US011193500B2

(12) United States Patent
Kimpara et al.

(10) Patent No.: US 11,193,500 B2
(45) **Date of Patent: *Dec. 7, 2021**

(54) BLOWER DEVICE

(71) Applicants: MINEBEA MITSUMI Inc., Nagano (JP); TOYOTA JIDOSHA KABUSHIKI KAISHA, Toyota (JP)

(72) Inventors: Shuhei Kimpara, Fukuroi (JP); Seiya Yoshitome, Toyota (JP); Hideaki Goda, Toyota (JP); Makoto Hidaka, Seto (JP)

(73) Assignees: MINEBEA MITSUMI INC., Kitasaku (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/874,814

(22) Filed: May 15, 2020

(65) Prior Publication Data

US 2020/0362881 A1 Nov. 19, 2020

(30) Foreign Application Priority Data

May 15, 2019 (JP) ..... JP2019-092159

(51) Int. Cl.
*F04D 29/62* (2006.01)
*F04D 29/42* (2006.01)

(52) U.S. Cl.
CPC ..... *F04D 29/624* (2013.01); *F04D 29/4226* (2013.01); *F05B 2240/14* (2013.01); *F05B 2240/90* (2013.01); *F05B 2260/30* (2013.01)

(58) Field of Classification Search
CPC ..... F04D 29/624; F04D 29/4226; F05B 2240/90; F05B 2240/14; F05B 2260/30; F28D 2021/0028; F28D 2021/0029; H01L 23/40; H01L 23/46; F28F 9/001; F28F 9/002; B60H 1/00521
See application file for complete search history.

(56) References Cited

U.S. PATENT DOCUMENTS 5,878,594 A * 3/1999 Lazzaro ..... B60H 1/00535 62/474
6,298,908 B1 * 10/2001 Harrell ..... B60H 1/00521 165/69

(Continued)

FOREIGN PATENT DOCUMENTS

JP 2013-104365 A 5/2013

*Primary Examiner* — Justin D Seabe
*Assistant Examiner* — Ryan C Clark
(74) *Attorney, Agent, or Firm* — Oliff PLC

(57) ABSTRACT

It is possible to provide a blower device in which the fixing position of the blower device is easily changed and the increase in cost is greatly suppressed. A blower device 100 in which a flange 201 having a fixing attaching foot 200 is attached to rails 108 and 109 formed on an outer circumferential surface of a casing 103, and a retaining block 205 is attached to the flange 201 to secure the flange 201 to the casing 103, the retaining block 205 includes a first block, a second block, and a connecting portion having smaller width and connecting the first block and the second block, and the first block and the second block each include a retaining leg portion and a latching leg portion, and a projecting portion is formed on a side surface of the retaining leg portion.

3 Claims, 3 Drawing Sheets

(56) References Cited

U.S. PATENT DOCUMENTS

| | | | | |
|---|---|---|---|---|
| 6,510,891 | B2 * | 1/2003 | Anderson | B60K 11/04 165/121 |
| 7,090,710 | B2 * | 8/2006 | Choi | B60H 1/00521 123/184.21 |
| 9,985,495 | B2 * | 5/2018 | Beetz | B60H 1/00521 |
| 10,190,670 | B2 * | 1/2019 | Berrade | F16F 15/02 |
| 10,495,058 | B2 * | 12/2019 | Shain | F03D 1/0675 |
| 2005/0008428 | A1 * | 1/2005 | Desai | F28D 1/0408 403/13 |
| 2007/0209372 | A1 * | 9/2007 | Mazzocco | F28F 9/002 62/67 |
| 2010/0129221 | A1 * | 5/2010 | Huxley-Reynard | F03B 13/264 416/169 R |
| 2011/0135492 | A1 * | 6/2011 | Tetambe | F03D 13/20 416/244 R |
| 2016/0023533 | A1 * | 1/2016 | Chikagawa | B60H 1/00021 454/156 |
| 2016/0363398 | A1 * | 12/2016 | Kim | F28F 3/046 |
| 2019/0219067 | A1 * | 7/2019 | Chen | F04D 29/646 |

* cited by examiner

BLOWER DEVICE

TECHNICAL FIELD

The present invention relates to a blower device, and more particularly, relates to a blower device in which a centrifugal fan is used.

BACKGROUND ART

Blower devices using centrifugal fans are widely used for cooling, ventilation, air conditioning of home electrical appliances, office automation equipment and industrial equipment, and vehicle equipment, and the like. As a structure for fixing the blower device to a housing or the like, a structure is known as described in Patent Document 1. In the structure of the Patent Document 1, fixing of the blower case to the attachment target is performed by using a foot part for fixing and attaching integrally, molded with the blower case.

Patent Document 1: Japanese Unexamined Patent Application Publication No. 2013-104365

SUMMARY OF THE INVENTION

However, in the blower device described in Patent Document 1, since the fixing and attaching foot is formed integrally with the blower case, for example, it is necessary to change a molding die for a lower blower case when changing the fixing position on the blower side. This requires multiple different molds to be prepared, which results in high cost.

In view of such circumstances, it is an object of the present invention to provide a blower device in which the fixing position of the blower apparatus can be easily changed and increase in cost is greatly suppressed.

The present invention is a blower device including: a case having a plurality of guide rail portions provided on an outer circumferential surface thereof, the guide rail portion having two rail-shaped projections, a flange having a fixing attaching foot attached on the guide rail portion, and a retaining block attached to the flange so as to fix the flange onto the case, the retaining block comprises a first block, a second block, and a connecting portion which connects the first block and the second block and has a width smaller than a width of the first block and the second block, and the first block and the second block each include a retaining leg portion and a latching leg portion.

In the present invention, an embodiment may be mentioned in which the flange includes a groove for engaging the rail-shaped projection and a latching portion for contacting an end of the rail-shaped projection, the retaining leg portion includes a projecting portion projecting to a direction of the rail-shaped projection, and the latching portion contacts one end of the rail-shaped projection and the projecting portion contacts the other end of the rail-shaped projection, so as to fix the flange onto the outer circumferential surface of the case.

In the present invention, an embodiment may be mentioned, in which the flange includes a first opening into which the retaining leg portion is inserted and a second opening into which the latching leg portion is inserted, the retaining leg portion is inserted into the first opening and the latching leg portion is inserted into the second opening, so as to attach the retaining block to the flange, and the connecting portion is elastically deformed when in the attached condition.

EFFECT OF THE INVENTION

According to the present invention, it is possible to obtain a blower device in which the fixing position of the blower device can be easily changed and the increase in cost is greatly suppressed.

BEST MODE FOR CARRYING OUT THE INVENTION (Structure)

Figure 1:
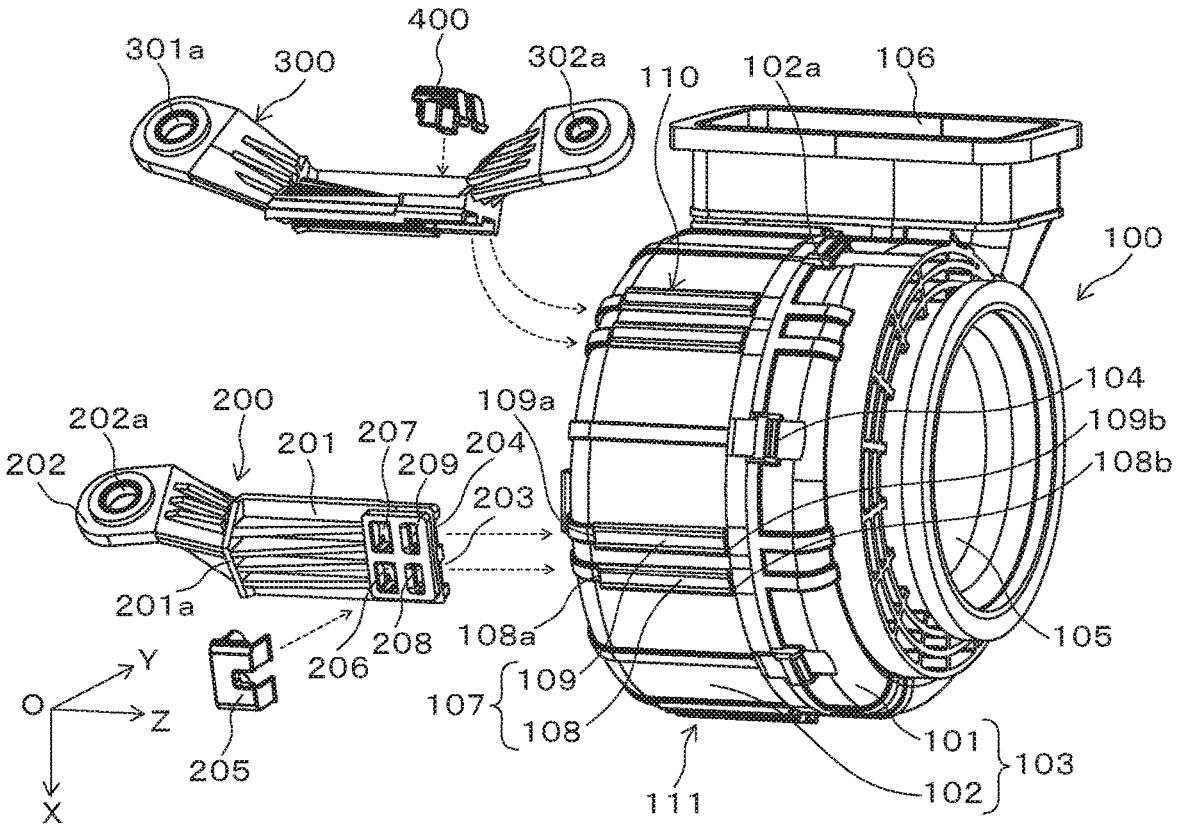
FIG. 1 is a perspective view of the embodiment.

First, the blower device is explained. FIG. 1 shows a blower device 100. The internal structure and operation mode of the blower device 100 are the same as those of a conventional blower device. In the following explanation, the axial direction means a direction of a rotation axis of an impeller of a centrifugal fan (not shown) inside the blower device 100, and is the Z-axis direction in the drawing. The upper direction means a direction in which an upper casing 101 is viewed from a lower casing 102, that is, a positive Z-axis direction, and the lower direction is the opposite direction thereof.

The blower device 100 includes a casing 103 composed of the upper casing 101 and the lower casing 102. The upper casing 101 and the lower casing 102 are manufactured by an injection molding method using a resin. A centrifugal fan is housed in the casing 103.

A plurality of locking portions (claw portions) 102*a* are formed on the upper end side of the lower casing 102 along the circumferential direction. A plurality of receiving portions (openings) to which the locking portions (claw portions) 102*a* are locked in the axial direction are formed on the lower end side of the upper casing 101 corresponding thereto.

Figure 2:
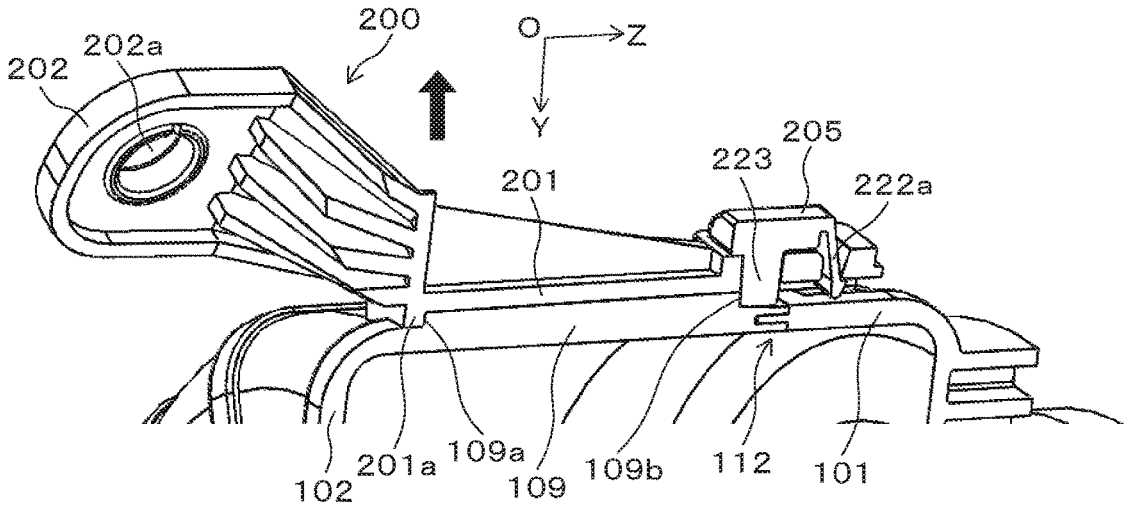
FIG. 2 is a perspective sectional view showing a coupling condition of the fixing attaching foot to the blower device case.

A concave portion oriented in the axial direction is formed at an edge portion of the upper end of the lower casing 102, and a convex portion engaging with the concave portion is formed at an edge portion of the lower end of the upper casing 101. The upper casing 101 and the lower casing 102 are coupled to each other by fitting the concave portion and the convex portion, and further by hooking and locking the locking portion 102*a* to the upper casing 101. FIG. 2 shows an engaging structure 112 formed by engagement of the concave portion and convex portion. The situation in which the upper casing 101 and the lower casing 102 are coupled to each other is fixed by using a snap fit 104 which is a mechanical fixing member.

The upper casing 101 is provided with an air inlet 105 opened in the axial direction. Inside the casing 103, a centrifugal fan, which is not shown in the drawing, is housed. The blower device 100 includes a motor for driving an impeller of the centrifugal fan, and the Z-axis is in the direction of the rotation axis of the impeller. As the impeller rotates, air is drawn from the air inlet 105.

A spiral-shaped flow path is formed inside the casing 103, and an air outlet 106 is formed at a terminal end portion of the flow path. Air drawn in from the air inlet 105 in accordance with the rotation of the impeller is blown from the inside of the impeller in the radially outward direction, conveyed through the spiral-shaped flow path, and blown out from the air outlet 106.

The lower casing 102 has a cylindrical shape, and a guide rail portion 107 is provided on the outer circumference thereof. The guide rail portion 107 has a projecting shape in cross section and has two rails 108 and 109 extending in the axial direction. Reference numerals 110 and 111 indicate other guide rail portions having the same structure as the guide rail portion 107. A plurality of similar guide rail portions are also provided on the rear surface side in the situation shown in FIG. 1.

The two rails 108 and 109 constituting the guide rail portion 107 have the same structure, and are arranged in parallel with each other at intervals therebetween in a condition extending in the axial direction on the outer circumferential surface of the lower casing 102.

Figure 3:
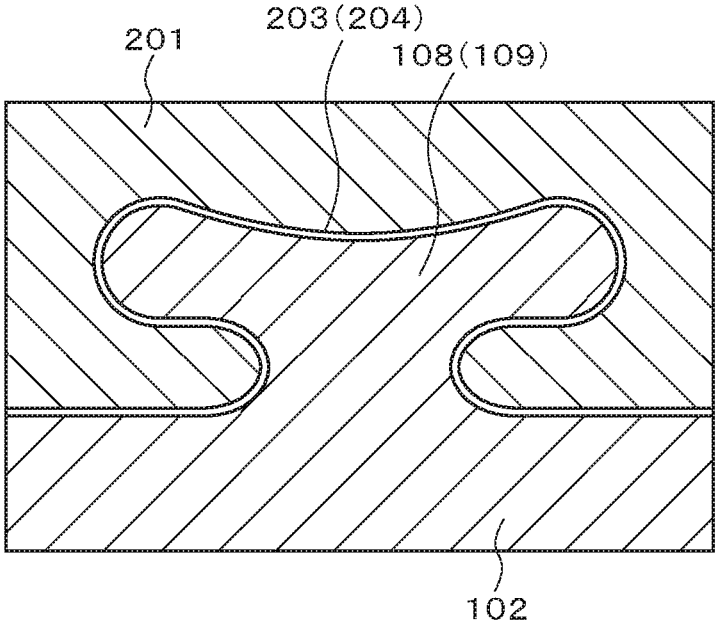
FIG. 3 is a cross-sectional view showing a coupling condition of the fixing attaching foot to the blower device case.

FIG. 3 shows a cross section of the rails 108, 109 seen from the axial direction (Z axis direction). The rails 108 and 109 have a projecting structure when viewed from the extending direction, and have an approximately T-shaped shape that is vertically collapsed. As shown in FIG. 1, the rail 109 has a lower end 109*a* and an upper end 109*b* in the extending direction thereof. Similarly, the rail 108 has a lower end 108*a* and an upper end 108*b* in the extending direction thereof.

A fixing attaching foot 200 is fixed to the lower casing 102 using the guide rail portion 107. The fixing attaching foot 200 includes a flange 201 and a fixing portion 202 in which a through hole 202*a* for inserting a fastening member, such as a bolt, is formed.

The flange 201 is formed with two grooves 203 and 204 which engage with the rails 108 and 109. Each of the grooves 203 and 204 is shaped to engage with the rails 108 and 109 and extends axially.

As shown in FIG. 3, the rails 108 and 109 have an approximately T-shaped cross-sectional shape, and the grooves 203 and 204 have a shape to receive the approximately T-shape. Therefore, when the rail 108 is engaged and fitted in the groove 203 in the axial direction and the rail 109 is engaged and fitted in the groove 204 in the axial direction, the fixing attaching foot 200 is slidable in the axial direction (Z-axis direction) with respect to the lower casing 102, but is restrained from moving in the other directions.

For example, a case is explained, in which the fixing attaching foot 200 is attached to the guide rail portion 107 of the casing 103 (blower device 100). In this case, the groove 203 of the fixing attaching foot 200 (flange 201) is engaged with the rail 108 and the groove 204 is engaged with the rail 109 from the Z-axis negative direction, and the fixing attaching foot 200 is slid in the Z-axis positive direction (axial direction) as it is.

The lower end portion of the flange 201 is provided with a locking portion 201*a* extending in a direction orthogonal to the axial direction. When the fixing attaching foot 200 is slid in the Z-axis positive direction (axial direction) in a condition in which the grooves 203 and 204 are engaged with the rails 108 and 109, the locking portion 201*a* finally comes into contact with the lower end 108*a* of the rail 108 and the lower end 109*a* of the rail 109, and the fixing attaching foot 200 cannot be pushed further in the Z-axis positive direction any more. In this manner, the fixing attaching foot 200 is aligned on the guide rail portion 107 (casing 103).

In this situation, since the fixing attaching foot 200 is slidable in the opposite direction (Z-axis negative direction), the fixing attaching foot 200 is prevented from moving in the axial direction by using a retaining block 205. In this manner, the fixing attaching foot 200 is fixed to the casing 103 (guide rail portion 107).

Figure 4:
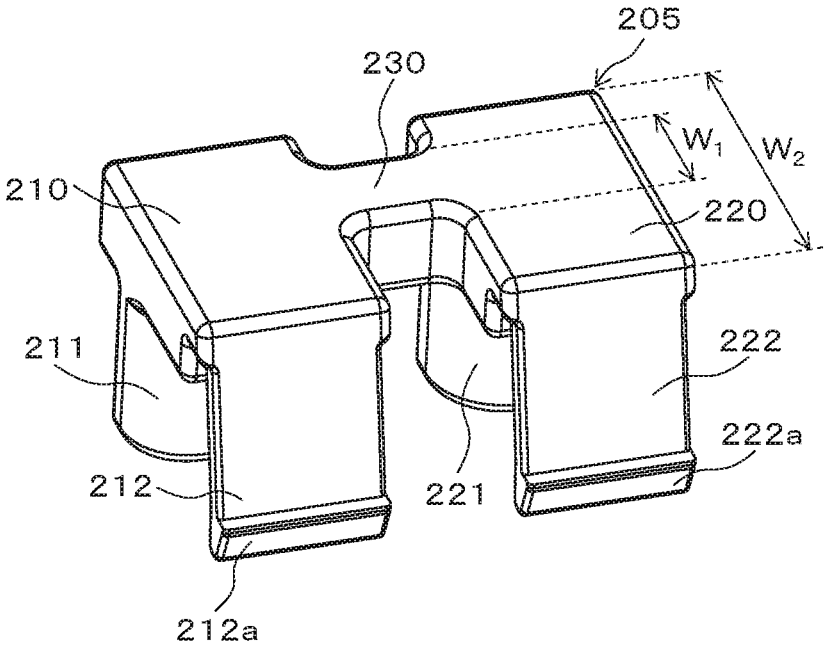
FIG. 4 is a perspective view of the retaining block shown in FIG. 1.
Figure 5:
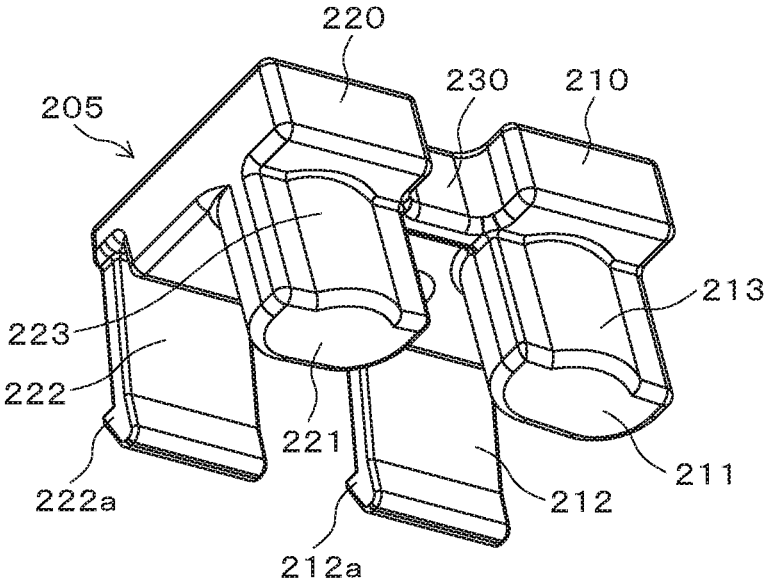
FIG. 5 is a perspective view of the retaining block shown in FIG. 1.

The retaining block 205 is shown in FIGS. 4 and 5. The retaining block 205 is integrally molded by injection molding resin, and it has a structure in which a first block 210 and a second block 220 are connected by a connecting portion 230. The connecting portion 230 has a width dimension (dimension in a direction perpendicular to a line connecting the first block 210 and the second block 220) $W_1$, which is considered in the direction of the line connecting the first block 210 and the second block 220, smaller than a width $W_2$ of the first block 210 and the second block 220, which are considered to be in the same direction.

The first block 210 includes a retaining leg portion 211 and a latching leg portion 212. The second block 220 includes a retaining leg portion 221 and a latching leg portion 222. On the surface of the retaining leg portion 211 opposite to the latching leg portion 212 (on the surface of a side of the upper end 108*a* of the rail 108 in a situation of being attached on the flange 201), a projecting portion 213 which projects in an arc-shape is provided. The projecting portion 213 projects in a direction of extension of the rail 108 (a negative direction of the Z-axis) in a condition in which the retaining block 205 is attached on the flange 201. A claw portion 212*a* is formed at the distal end of the latching leg portion 212.

On the surface of the retaining leg portion 221 opposite to the latching leg portion 222, a projecting portion 223 which projects in an arc-shape is provided in a manner similar to that of the projecting portion 213. A claw portion 222*a* is formed at the distal end of the latching leg portion 222.

Four openings 206, 207, 208, and 209 are formed in the flange 201 of the fixing attaching foot 200. These openings are through holes. The retaining leg portions 211 and 221 of the retaining block 205 are inserted into the openings 206 and 207, and the latching leg portions 212 and 222 are inserted into the openings 208 and 209, whereby the retaining block 205 is attached to the fixing attaching foot 200.

For example, a case in which the fixing attaching foot 200 is fixed to the guide rail portion 107 is explained. In this case, the retaining block 205 is attached to the fixing attaching foot 200 in a condition in which the fixing attaching foot 200 is attached to the guide rail portion 107.

Here, the retaining leg portion 211 is inserted into the opening 206, and the retaining leg portion 221 is inserted into the opening 207. The latching leg portion 212 is inserted into the opening 208, and the latching leg 222 is inserted into the opening 209.

In this situation, the retaining leg portions 211 and 221 penetrate the openings 206 and 207, and the tips thereof project to the back side of the flange 201. In this portion, the projecting portion 213 contacts the upper end 108*b* of the rail 108, and the projecting portion 223 contacts the upper end 109*b* of the rail 109. As a result, the fixing attaching foot 200 cannot move in the negative Z-axis direction on the guide rail portion 107.

As shown in FIG. 2, since the locking portion 201*a* of the fixing attaching foot 200 contacts the lower end 108*a* of the rail 108 and the lower end 109*a* of the rail 109 in the axial direction, the fixing attaching foot 200 cannot move in the positive Z-axis direction on the guide rail portion 107. In addition, due to the engaging structure shown in FIG. 3, the fixing attaching foot 200 cannot move with respect to the lower casing 102 except in the Z-axis direction in a condition in which the retaining block 205 is not provided. Therefore, by attaching the retaining block 205 as explained above, the fixing attaching foot 200 is fixed to the guide rail portion 107 (the casing 103), so that it cannot move.

On the other hand, the latching leg portion 212 is inserted into the opening 208, and the claw portion 212*a* engages with the edge on the back side of the opening 208 by being caught. Furthermore, the latching leg portion 222 is inserted into the opening 209, and the claw portion 222*a* engages with the edge on the back side of the opening 209 by being caught. As a result, the latching leg portions 212 and 222 cannot come out of the openings 208 and 209, and the retaining block 205 is fixed to the fixing attaching foot 200.

In the example of FIG. 1, in addition to the fixing attaching foot 200, a fixing attaching foot 300 is fixed to the guide rail portion 110. The fixing structure of the fixing attaching foot 300 to the casing 103 is the same as that of the fixing attaching foot 200. Furthermore, the same point as in the case of the fixing attaching foot 200 is that the fixing attaching foot 300 is prevented from moving with respect to the casing 103 by a retaining block 400 having the same structure as the retaining block 205.

In the case of FIG. 1, the blower device 100 is fixed to an object (a housing or the like containing an object to be cooled) by bolts using the through-holes 202*a* of the fixing attaching foot 200 and the through-holes 301*a* and 302*a* of the fixing attaching foot 300.

The fixing of the fixing attaching foot 200 and the fixing attaching foot 300 to the casing 103 may be performed on other guide rail portions. A structure of fixing the fixing attaching foot to any of the guide rail portions is the same. In addition, the retaining blocks 205 can be commonly used, a shape other than that shown in the figure can be prepared as a shape of the fixing attaching foot, and they can be used in combination as appropriate and as necessary.

According to the above structure, it is not necessary to change the shape of the casing of the blower device, and it is possible to cope with various variations in the fixing position of the fixing attaching foot. Even when the shape of the fixing attaching leg is different, it is possible to cope with the difference only by preparing the fixing attaching leg corresponding to the shape.

(Features)

Since the guide rail portion 110 formed on the outer circumferential surface of the lower casing 102, the fixed mounting foot 200, and the retaining block 205 are molded by injection molding resin, dimensional accuracy is difficult to realize. Therefore, when the arc-shaped projecting portions 213 and 223 formed on the side surfaces of the retaining leg portions 211 and 221 of the first block 210 and the second block 220 of the retaining block 205 are inserted (press-fit) into the openings (through holes) 206 and 207 of the fixed mounting foot 200 and are pressed against the upper ends 108*b* and 109*b* of the rails 108 and 109, if the dimensions of the left and right retaining leg portions 211 and 221 are varied and there is no connecting portion 230, the retaining block 205 is difficult to elastically deform, and mounting of the retaining block 205 is difficult, or force concentration occurs around the bases of the retaining leg portions 211 and 221 and are damaged when forcibly inserted.

On the other hand, in the present embodiment, the connecting portion 230 having a small width for connecting the first block 210 and the second block 220 is formed. In this manner, when the arc-shaped projecting portions 213 and 223 formed on the side surfaces of the retaining leg portions 211 and 221 of the first block 210 and the second block 220 are pressed against the upper ends 108*b* and 109*b* of the rails 108 and 109, respectively, the connecting portion 230 can be elastically deformed slightly, thereby increasing the degree of freedom of movement of the first block 210 and the second block 220, respectively. This facilitates attachment of the retaining block 205 to the fixing attaching foot 200, thereby obtaining high workability. In addition, by deforming the connecting portion 230 slightly and elastically, the retaining block 205 is fixed to the fixing attaching foot 200 in a condition in which there is no backlash.

In the present embodiment, the flange 201 is formed with the grooves 203 and 204 that engage with the rails 108 and 109, the flange 201 is provided with a locking portion 201*a* that contacts the lower ends 108*a* and 109*a* of the rails 108 and 109, the locking portion 201*a* contacts the lower ends 108*a* and 109*a* of the rails 108 and 109, and the projecting portions 213 and 223 of the retaining block 205 contact the upper ends 108*b* and 109*b* of the rails 108 and 109, whereby the flange 201 is fixed to the outer circumferential surface of the casing 103.

According to this structure, the flange 201 is locked to both ends of the rails 108 and 109, and the flange 201 cannot move in the axial direction, so that the fixing attaching foot 200 is securely fixed to the casing 103. Like the fixing attaching foot 200, the fixing attaching foot 300 is also securely fixed to the casing 103.

EXPLANATION OF REFERENCE NUMERALS

100: blower device, 101: upper casing, 102: lower casing, 102*a*: locking portion, 103: casing, 104: snap-fit, 105: air inlet, 106: air outlet, 107: guide rail portion, 108: rail, 108*a*: lower end, 108*b*: upper end, 109: rail, 109*a*: lower end, 109*b*: upper end, 110: guide rail portion, 111: guide rail portion, 112: engaging and fitting structure by engagement of concave portion and convex portion, 200: fixing attaching foot, 201: flange, 201*a*: locking portion, 202: fixing portion, 202*a*: through hole, 203: groove, 204: groove, 205: retaining block, 206: opening, 207: opening, 208: opening, 209: opening, 210: first block, 211: retaining leg portion, 212: latching leg portion, 212*a*: claw portion, 213: projecting portion, 220: second block, 221: retaining leg portion, 222: latching leg portion, 222*a*: claw portion, 223: projecting portion, 230: connecting portion, 300: fixing attaching foot, 301*a*: through hole, 302*a*: through hole, 400: retaining block.

What is claimed is:

1. A blower device comprising:

a case having a plurality of guide rail portions provided on an outer circumferential surface thereof, the guide rail portion having two rail-shaped projections, a flange having a fixing attaching foot attached on the guide rail portion, and a retaining block attached to the flange so as to fix the flange onto the case, wherein the retaining block comprises a first block, a second block and a connecting portion which connects the first block and the second block and has a width smaller than a width of the first block and the second block, and the first block and the second block each comprises a retaining leg portion and a latching leg portion.

2. The blower device according to claim 1, wherein the flange includes a groove for engaging the rail-shaped projection and a latching portion for contacting an end of the rail-shaped projection, the retaining leg portion includes a projecting portion projecting to a direction of the rail-shaped projection, and the latching portion contacts one end of the rail-shaped projection and the projecting portion contacts the other end of the rail-shaped projection, so as to fix the flange onto the outer circumferential surface of the case.

3. The blower device according to claim 1, wherein the flange includes a first opening into which the retaining leg portion is inserted and a second opening into which the latching leg portion is inserted, the retaining leg portion is inserted into the first opening and the latching leg portion is inserted into the second opening, so as to attach the retaining block to the flange, and the connecting portion is elastically deformed under the attached condition.

* * * * *